US010512948B2

(12) United States Patent
Iwamoto et al.

(10) Patent No.: US 10,512,948 B2
(45) Date of Patent: Dec. 24, 2019

(54) GAS PURGE UNIT AND GAS PURGE APPARATUS

(71) Applicant: TDK CORPORATION, Minato-ku, Tokyo (JP)

(72) Inventors: Tadamasa Iwamoto, Tokyo (JP); Jun Emoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 652 days.

(21) Appl. No.: 14/946,521

(22) Filed: Nov. 19, 2015

(65) Prior Publication Data

US 2016/0207082 A1 Jul. 21, 2016

(30) Foreign Application Priority Data

Nov. 21, 2014 (JP) ..... 2014-236227

(51) Int. Cl.
*B08B 5/02* (2006.01)

(52) U.S. Cl.
CPC ..... *B08B 5/02* (2013.01)

(58) Field of Classification Search
CPC .. B08B 5/02; B08B 7/002; B08B 5/00; B08B 9/08; B08B 9/0813; B05B 1/005; B05B 1/14; B05B 1/28; B05B 1/34; H01L 21/67034; H01L 21/67028; H01L 21/67389
USPC ..... 15/316.1, 406, 405, 316, 301
See application file for complete search history.

(56) References Cited

U.S. PATENT DOCUMENTS

2009/0169342 A1* 7/2009 Yoshimura ..... H01L 21/67772 414/217
2013/0042945 A1* 2/2013 Emoto ..... H01L 21/67017 141/98
2015/0040950 A1* 2/2015 Kaise ..... H01L 21/67034 134/22.18
2016/0118279 A1 4/2016 Iyer et al.

FOREIGN PATENT DOCUMENTS

JP 2008-135791 A 6/2008
JP 2008135791 A * 6/2008
JP 2013-161924 A 8/2013
WO WO 2005/124853 A1 12/2005
WO WO 2016/065200 4/2016
WO WO-2016065200 A1 * 4/2016 ..... H01L 21/67383

OTHER PUBLICATIONS

English translation WO2016065200 (Year: 2016).*
English translation JP2008135791 (Year: 2008).*

* cited by examiner

*Primary Examiner* — Monica S Carter
*Assistant Examiner* — Abbie E Quann
(74) *Attorney, Agent, or Firm* — Arent Fox LLP

(57) ABSTRACT

A gas purge unit 20 introduces a cleaning gas into a purging container 2 with an opening 2*b* therethrough. The gas purge unit 20 includes a first nozzle outlet 26 and a second nozzle outlet 28. The first nozzle outlet 26 blows out the cleaning gas from a lateral side line part of the opening 2*b* toward the inside of the purging container 2. The second nozzle outlet 28 blows out the cleaning gas from the lateral side line part of the opening 2*b* toward an opening surface of the opening 2*b*.

12 Claims, 17 Drawing Sheets

GAS PURGE UNIT AND GAS PURGE APPARATUS

BACKGROUND OF THE INVENTION

1. Field of the Invention

The present invention relates to a gas purge unit and a gas purge apparatus used for a manufacturing process of semiconductors, for example.

2. Description of the Related Art

In the manufacturing process of semiconductors, wafers housed in a wafer transfer container include ones on which metal wirings or so are formed, for example. It may become impossible to obtain desired characteristics at the time of completion of elements due to oxidation of the surface of such metal wirings. Thus, oxidation concentration inside the container is necessary to be kept at a low level.

However, when wafers in a pod are brought to various processing apparatuses for performing a predetermined processing thereto, the inside of the container and the inside of the processing apparatuses are constantly kept in a connected condition. A fan and a filter are arranged at the upper area of a room where a transfer robot is arranged, and a cleaning air with controlled particles is usually introduced into the room. However, when such an air enters into the container, surfaces of the wafers may become oxidized due to oxygen or water in the air.

For example, Patent Document 1 discloses that a purge gas such as nitrogen gas is introduced toward the inside of a container, and that a gas blows out toward an opening surface of an opening to prevent a dirty air from entering from the inside of a processing room into the container.

However, in conventional apparatuses, a container-inward nozzle blowing out a gas toward the inside of a container is arranged at a lateral side line part of an opening part, and a curtain nozzle blowing out a gas toward an opening surface of the opening part is arranged at an upper side line part of the opening part. The gas flow blown from the curtain nozzle is weak at a lower part of the opening surface, and a sufficient shielding effect (curtain effect) cannot be possibly obtained.

Thus, there is a problem that arrival rates for purge completion vary between upper and lower portions of the container. There is also a problem that gas exchange cannot be ideally performed due to complexity of channels of purge gas within the container. In such a case, for example, there is further a problem that oxygen or water concentration in the atmosphere varies between wafers placed at the lower portion of the container and wafers placed at the upper portion of the container, and that the wafers are thus processed unevenly in the subsequent manufacturing processes.

Patent Document 1: WO2005/124853 A1

SUMMARY OF THE INVENTION

The present invention has been achieved in consideration of the circumstances, and its object is to provide a gas purge unit and a gas purge apparatus capable of uniformly performing gas exchange particularly in the vertical direction in a purging container.

To achieve the above object, the gas purge unit according to the present invention is arranged for introducing a cleaning gas into a purge container with an opening therethrough, and comprises:

a first nozzle outlet blowing out the cleaning gas from a lateral side line part of the opening toward the inside of the purging container; and a second nozzle outlet blowing out the cleaning gas from the lateral side line part of the opening toward an opening surface of the opening.

In the gas purge unit of the present invention, the second nozzle outlet blowing out the cleaning gas toward the opening surface of the opening is arranged along the lateral side line part of the opening. Thus, the gas flow blown out from the second nozzle outlet creates a curtain flow that blocks a flow from the outside to the inside of the container through the opening. This curtain flow is generated from the lateral side line part of the opening of the container, and thus is uniform in the vertical direction of the container. Also, the first nozzle outlet blowing out the cleaning gas toward the inside of the container is arranged along the lateral side line part of the opening, and thus the container-inward flow is uniform in the vertical direction of the container.

The present invention thus makes it possible to uniformly perform gas exchange particularly in the vertical direction. As a result, it is possible to obtain a uniform quality of objects to be treated such as wafers housed in the vertical direction of the container.

Preferably, the first nozzle outlet and the second nozzle outlet are formed on a single bidirectional blowout member. This can reduce the number of parts and contributes to downsizing of the unit.

The bidirectional blowout member is arranged at least at one of the lateral side line parts of the opening. Preferably, the bidirectional blowout members are oppositely arranged at both of the lateral side line parts of the opening. In this construction, the curtain flows are generated from both of the lateral side line parts, which increases the effect of blocking the flow from the outside to the inside of the container through the opening. Also, the cleaning gases toward the inside of the container blow out from two points of both of lateral side line parts of the opening, and thus the gas exchange in the container is performed quickly and uniformly.

The first nozzle outlet may be formed on a first dedicated blowout member and the first dedicated blowout member may be arranged at least at one of the lateral side line parts of the opening. Also, the second nozzle outlet may be formed on a second dedicated blowout member and the second dedicated blowout member may be arranged at least at one of the lateral side line parts of the opening.

Preferably, the first dedicated blowout member is arranged closer to the opening than the second dedicated blowout member. In this arrangement, the curtain flow blown out from the second nozzle outlet of the second dedicated blowout member is prevented from interfering with the container-inward flow blown out from the first nozzle outlet of the first dedicated blowout member, and both flows become smooth.

Preferably, the first nozzle outlet and the second nozzle outlet are continuously or intermittently formed along the longitudinal direction of the lateral side line parts of the opening. The first nozzle outlet or the second nozzle outlet may be a narrow and long blowout slot like a slit or may be combination of a plurality of blowout holes. This nozzle outlet may be a slit-like through hole formed along the longitudinal direction of a tube member, a circular through hole, or a through hole formed inside of a nozzle protruding from a tube member.

A gas purge apparatus according to the present invention comprises the gas purge unit attached to at least one of the lateral side line parts of a wall-side opening on a wall, wherein the purging container is detachably attached from the outside to the wall-side opening formed on the wall sealed internally and the opening of the purging container and the wall-side opening are airtightly connected.

DESCRIPTION OF THE PREFERRED EMBODIMENTS

Figure 1A:
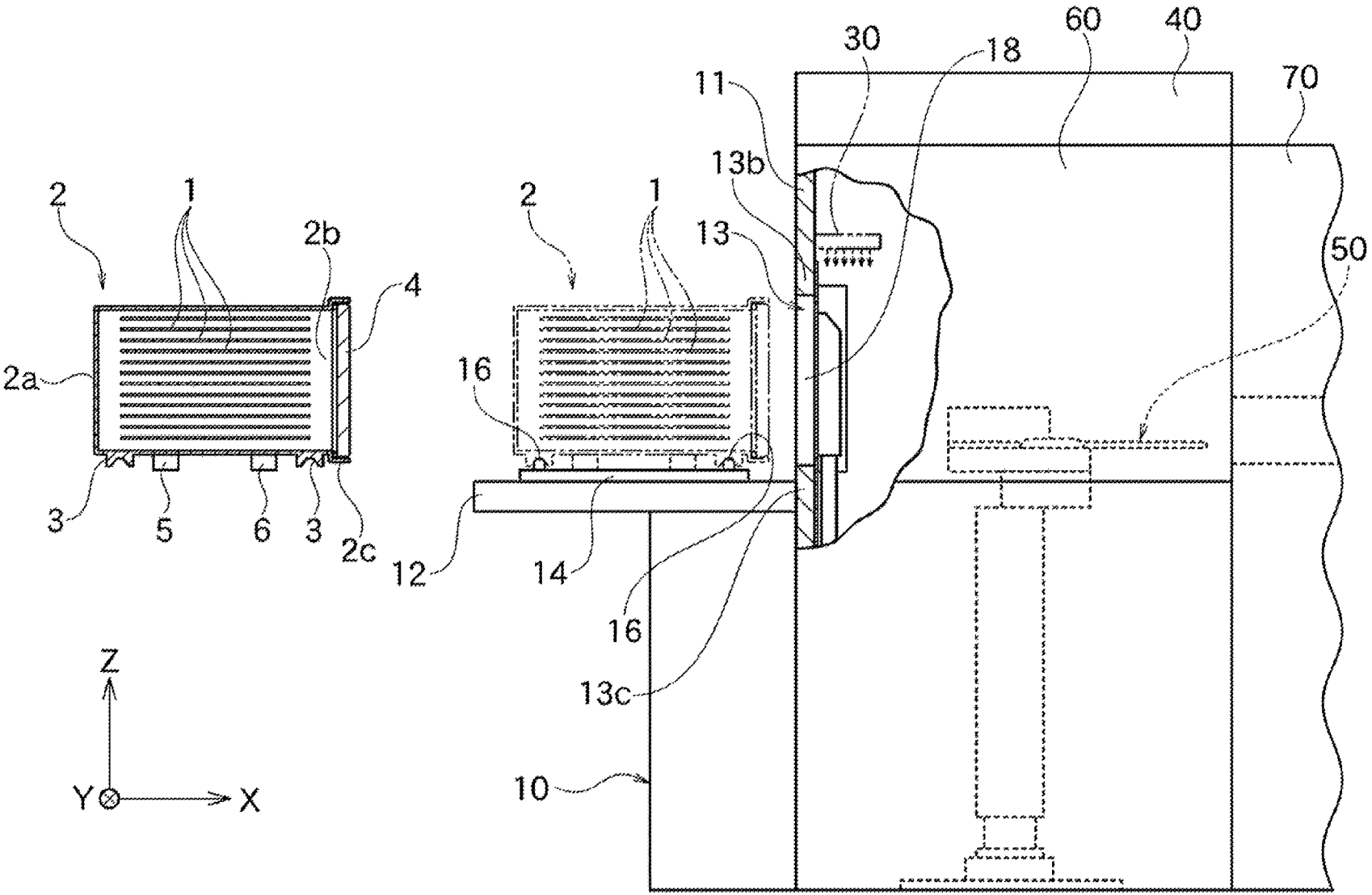
FIG. 1A is a partial cross-sectional schematic view of a load port apparatus to which a gas purge unit according to one embodiment of the present invention is applied.

Hereinafter, the present invention will be described with reference to embodiments shown in the drawings.

First Embodiment

As shown in FIG. 1A, a load port apparatus 10 according to one embodiment of the present invention is connected to an intermediate chamber 60 such as an equipment front end module (EFEM). The load port apparatus 10 has an installation stand 12 and a movable table 14. The movable table 14 is movable on the installation stand 12 in the X-axis direction. Note that, in the figures, the X-axis represents a moving direction of the movable table 14, the Z-axis represents a vertical direction, and the Y-axis represents a direction vertical to the X-axis and the Z-axis.

A sealed transport container 2 can be detachably placed on a top of the movable table 14 in the Z-axis direction. The sealed transport container 2 is comprised of a pot or a FOUP etc. for transporting a plurality of wafers 1 while they are sealed and stored, and has a casing 2*a*. A space for housing the wafers 1 to be processed is formed inside of the casing 2*a*. The casing 2*a* has an approximately box-like shape with an opening on one of its surfaces present in the horizontal direction.

The sealed transport container 2 also has a lid 4 for sealing an opening 2*b* of the casing 2*a*. Shelves (not shown) with multiple stages for holding the wafers 1 horizontally to be vertically overlapped are arranged inside of the casing 2*a*. The wafers 1 placed on the shelves are respectively housed inside of the container 2 at regular intervals.

The load port apparatus 10 is an interface device for transporting wafers housed in a sealed state in the sealed transport container 2 into the intermediate chamber 60 while maintaining a clean condition. One or plural processing chambers 70 are connected airtightly. The processing chamber 70 is not limited and is used, for example, for a vapor apparatus, a sputtering apparatus, an etching apparatus, and the like during semiconductor manufacturing process.

The intermediate chamber 60 houses a robot arm 50. A fan filter unit (FFU) 40 is mounted on the top of the intermediate chamber 60, and a clean air flows by downflow from the FFU 40 into the intermediate chamber 60 to create a partial clean environment. The inside of the intermediate chamber 60 is not cleaner than the inside of the sealed transport container 2 mentioned below, but is cleaner than the external environment.

The load port apparatus 10 has a door 18 for opening and closing a wall-side opening 13 of a wall 11. The wall 11 functions as a part of a casing for sealing inside of the intermediate chamber 60 in a clean condition. FIG. 3A to FIG. 3D will briefly explain how the door 18 moves.

Figure 3A:
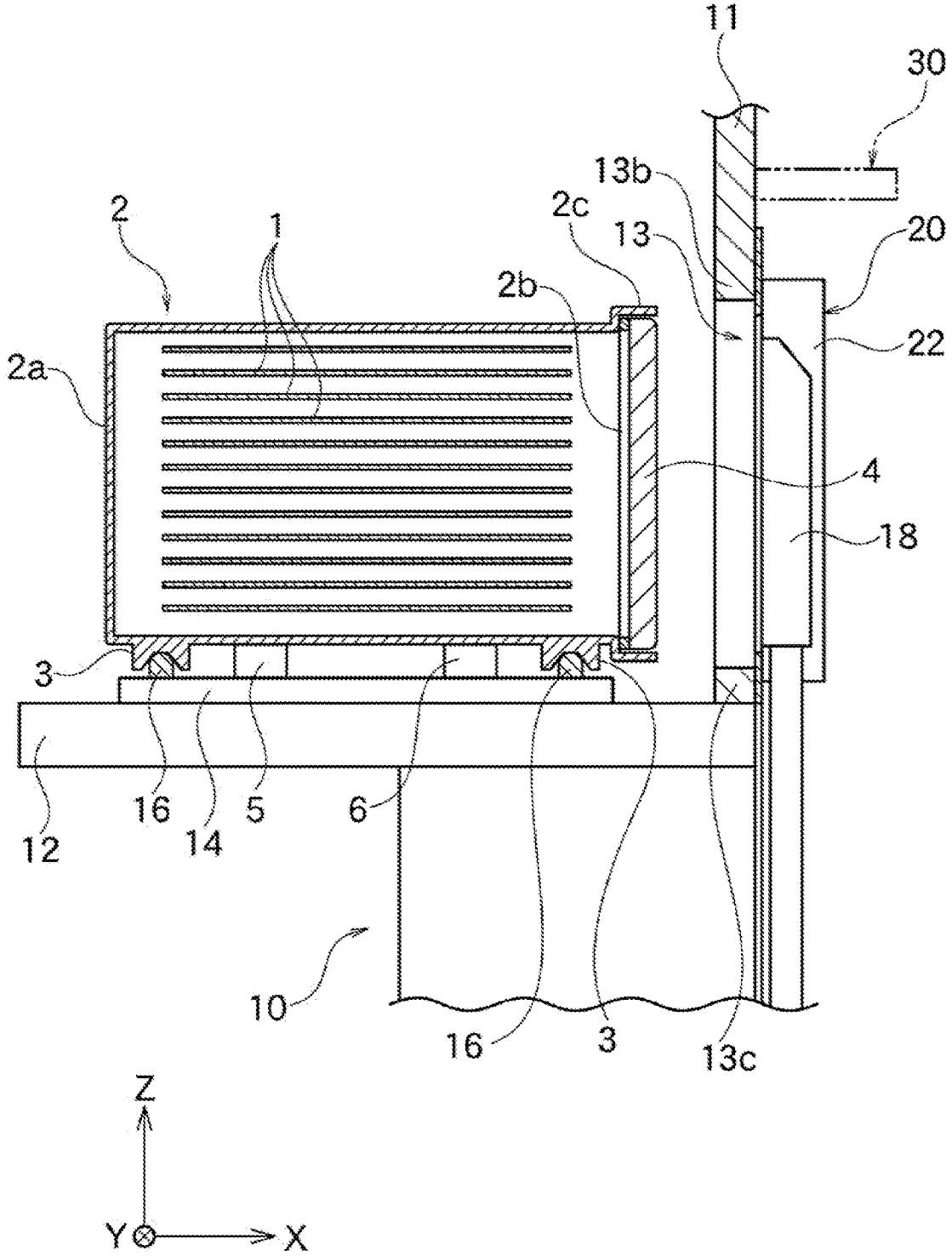
FIG. 3A is a schematic view showing a step where a lid of a FOUP is opened by a load port apparatus.

As shown in FIG. 3A, when the container 2 is mounted on the table 14, positioning pins 16 are engaged with concaves of positioning portions 3 arranged on a bottom surface of the casing 2*a* of the container 2, and then a positional relation between the container 2 and the movable table 14 is determined nonambiguously. During storage or transportation of the wafers 1, the sealed transport container 2 is internally sealed, and the surroundings of the wafers 1 are maintained in a clean environment.

Figure 3B:
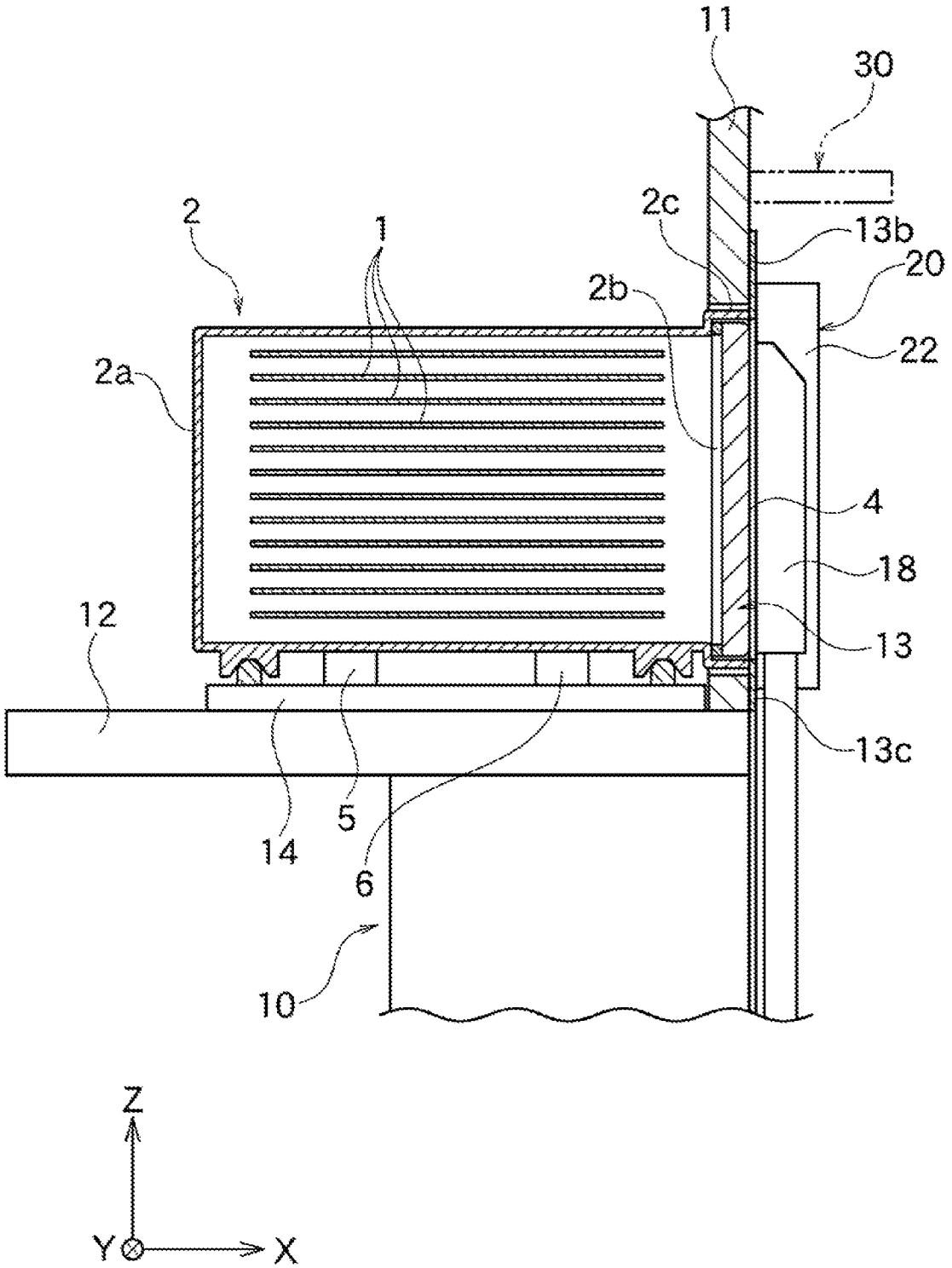
FIG. 3B is a schematic view showing a step continuous from the step of FIG. 3A.

When the sealed transport container 2 is positioned to be placed on the top surface of the movable table 14, an intake port 5 and an exhaust port 6, which are formed on the bottom surface of the sealed transport container 2, are respectively airtightly connected to a bottom purge apparatus placed inside of the table 14. Then, a bottom gas purge is performed through the intake port 5 and the exhaust port 6 positioned on the bottom of the container 2. As shown in FIG. 3B, under a condition that the bottom gas purge is being performed, the table 14 moves in the X-axis direction, and opening edges 2*c*, where the lid 4 airtightly sealing the opening 2*b* of the container 2 is attached, go into the wall-side opening 13 of the wall 11.

Figure 3C:
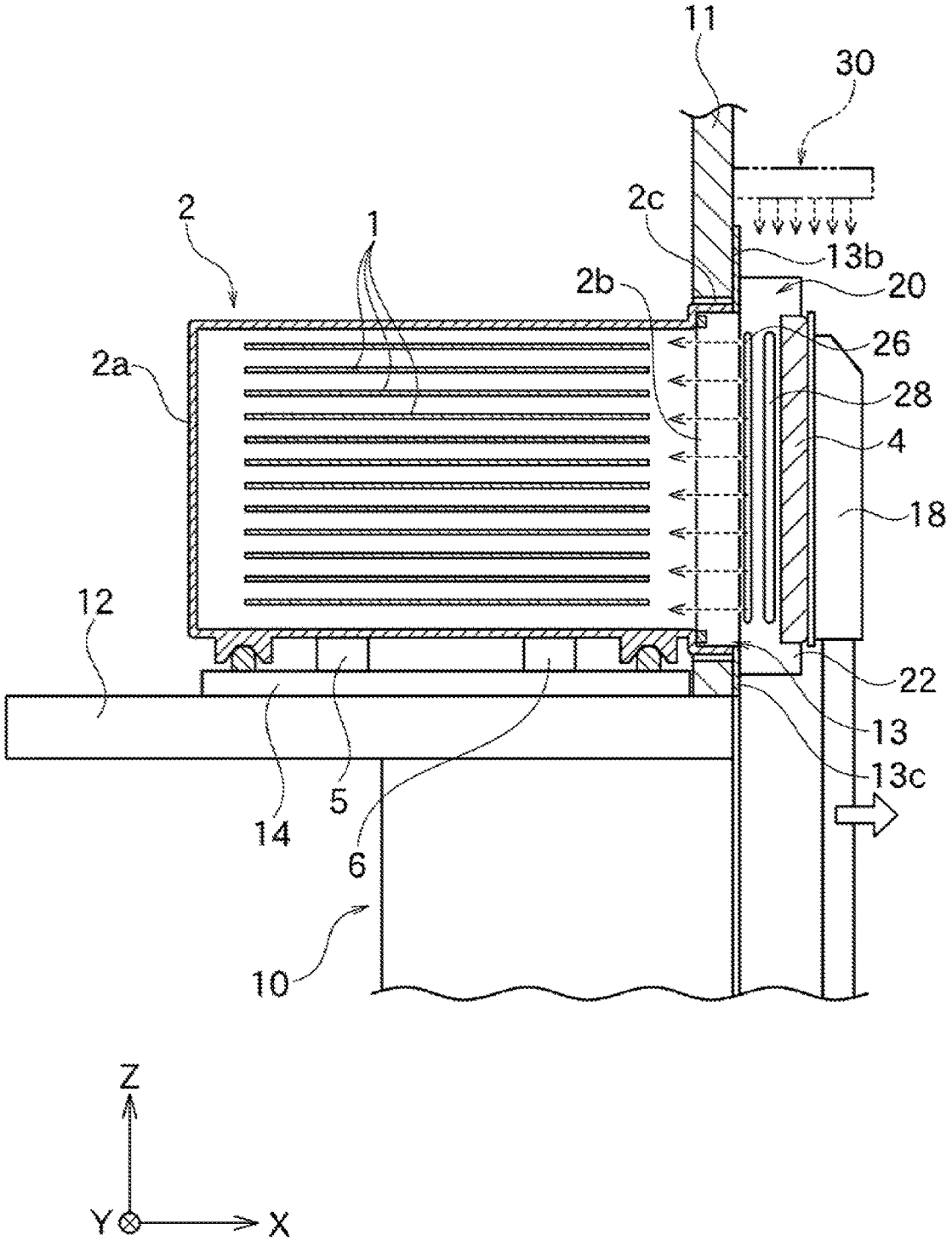
FIG. 3C is a schematic view showing a step continuous from the step of FIG. 3B.

At the same time, the door 18 located inside of the wall 11 (opposite side to the table 14) is engaged with the lid 4 of the container 2. At that time, a space between the opening edges 2*c* and opening edges of the wall-side opening 13 is sealed by a gasket or so, and the space is sealed in a good condition. Thereafter, as shown in FIG. 3C, the container 2 and the wall 11 are internally connected by moving the door 18 together with the lid 4 in parallel along the X-axis direction or moving them rotationally, detaching the lid 4 from the opening edges 2*c*, opening the opening 2*b*, and connecting the opening 2*b* and the wall-side opening 13.

At that time, the bottom gas purge may be continuously operated. In addition to the bottom purge or after stopping the bottom purge, purge gas (cleaning gas) such as nitrogen gas or any other inert gas is blown out (front purge) from the inside of the wall 11 into the container 2.

Figure 3D:
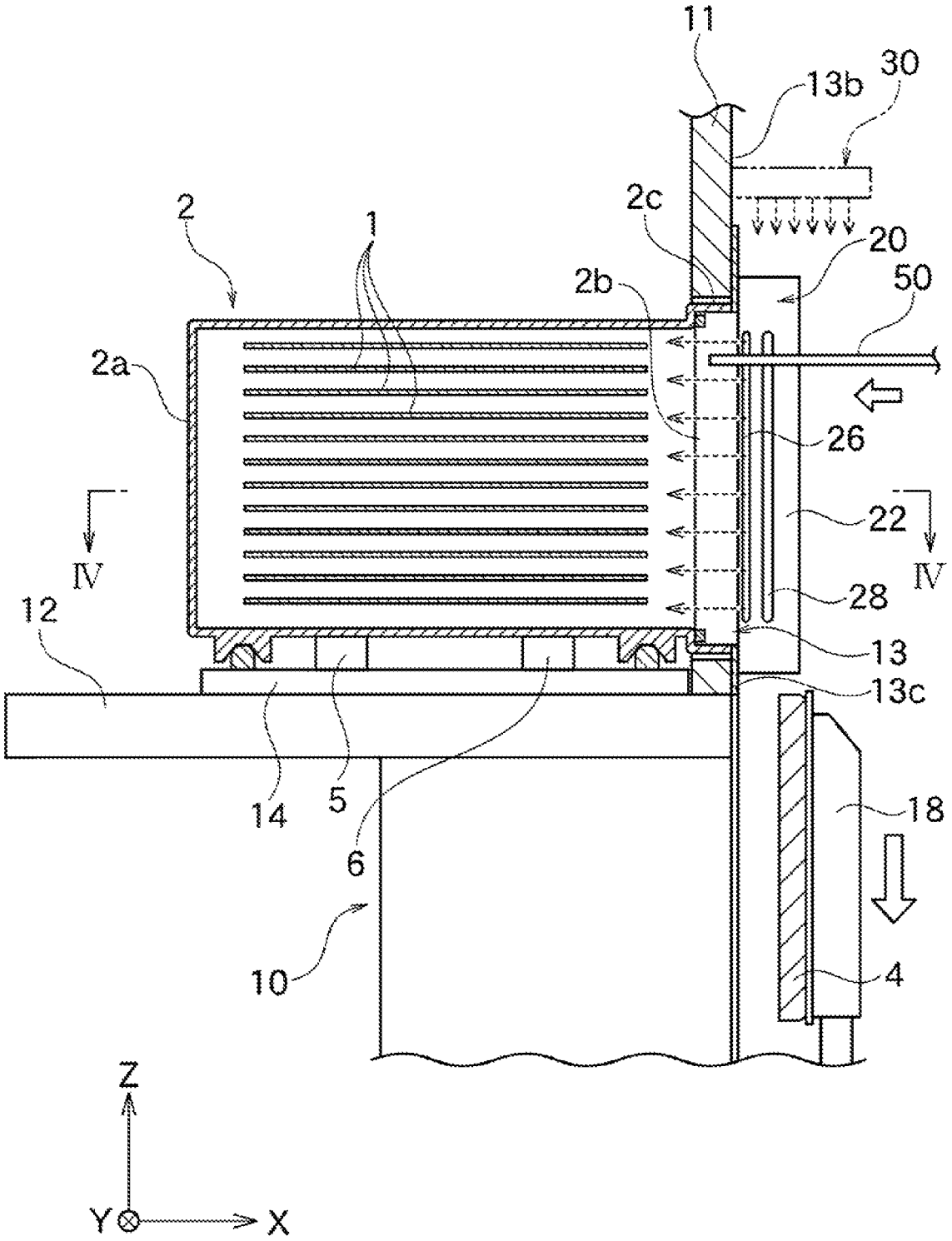
FIG. 3D is a schematic view showing a step continuous from the step of FIG. 3C.

Next, as shown in FIG. 3D, when the door 18 is moved downward in the Z-axis in the wall 11, the opening 2*b* of the container 2 completely opens to the inside of the wall 11, and the wafers 1 are exchanged into the wall 11 through the opening 2*b* and the wall-side opening 13 by such as a robot hand 50 arranged inside of the wall 11. At that time, the container 2 and the wall 11 are internally cut off from outside air, and at least the front purge is continuously operated to maintain a clean environment within the container 2. An operation opposite to the above is carried out to return the wafers 1 to the inside of the container 2 and detach it from the table 14.

Note that, the intake port 5, the exhaust port 6, the gas purge units 20, and the like are enlarged in the figures for easy understanding compared with the sealed transport container 2, but are different from actual dimension ratio.

Next, the gas purge unit 20 for performing front purge according to the present embodiment will be described with reference to the figures.

Figure 1B:
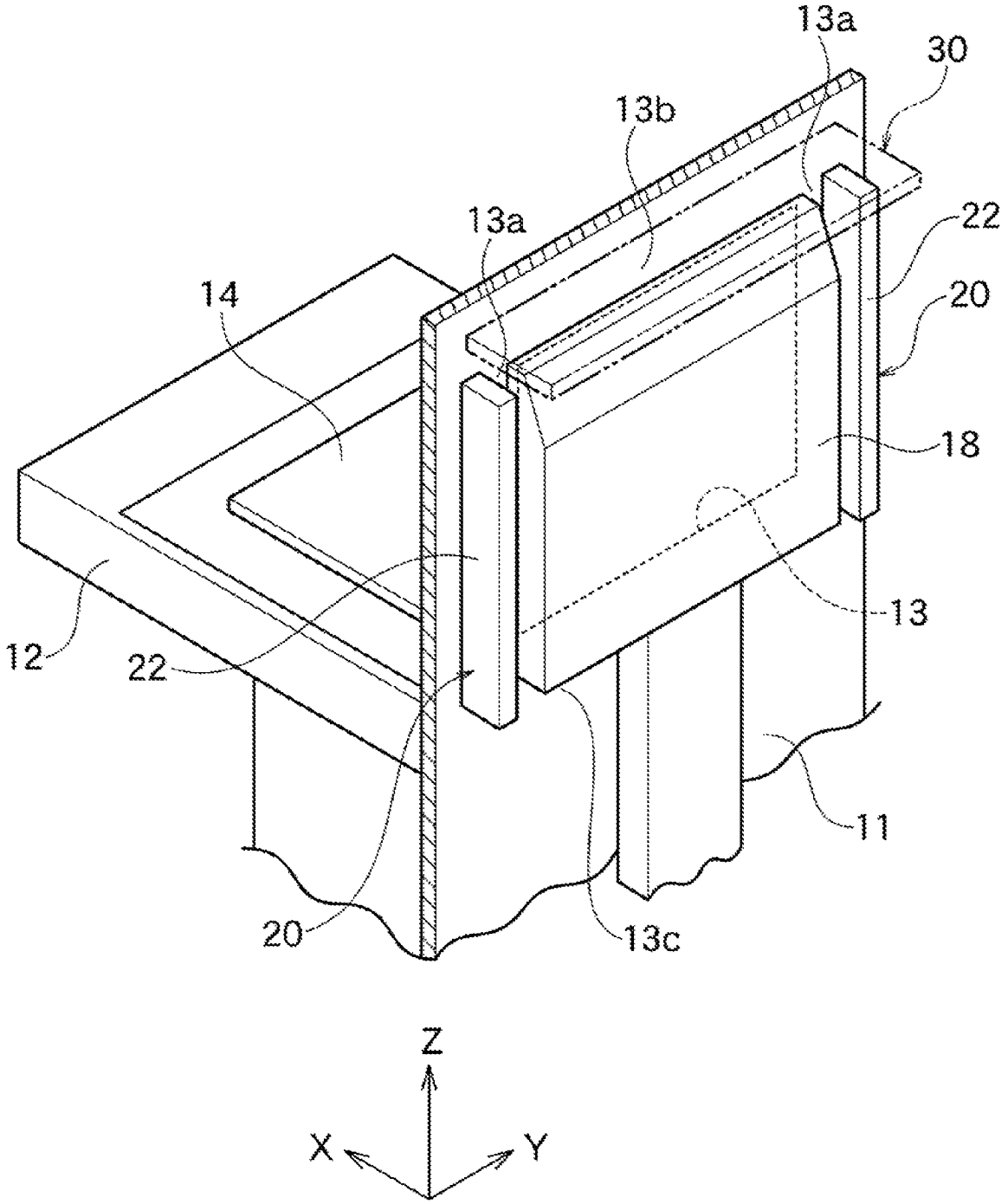
FIG. 1B is a partial cross-sectional perspective view of the load port apparatus shown in FIG. 1A.
Figure 4A:
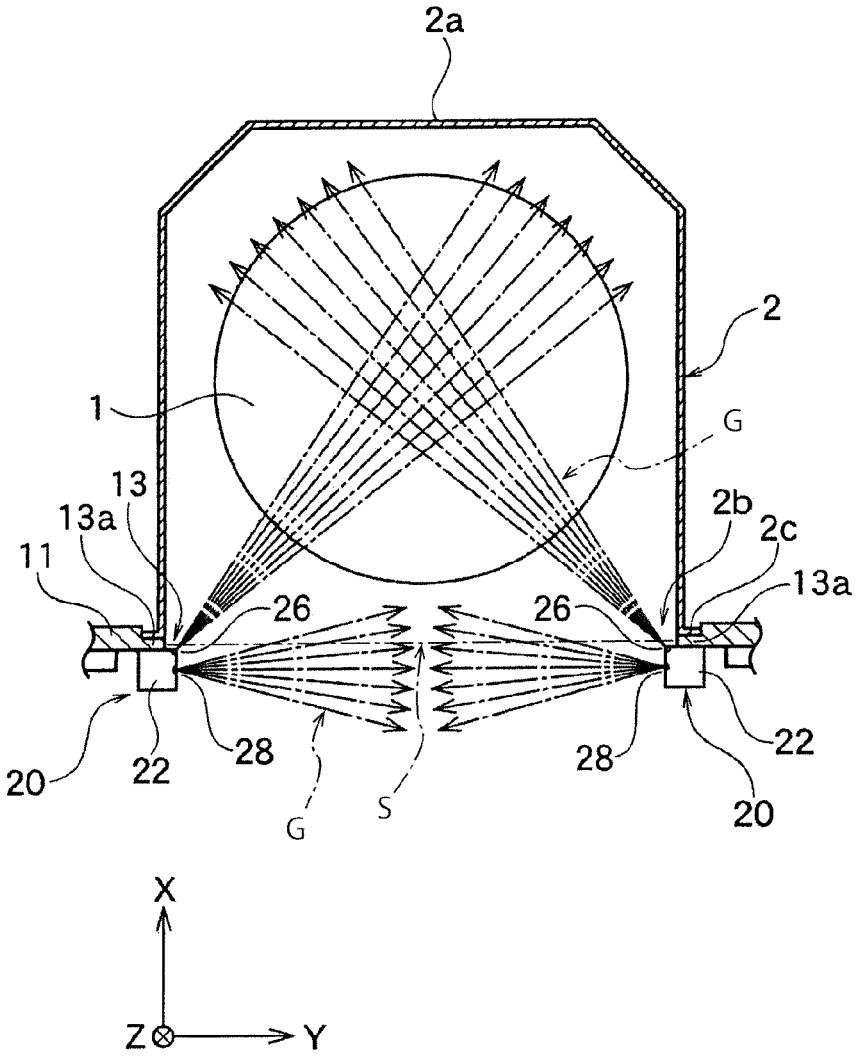
FIG. 4A is a cross-sectional view in a container taken along line IV-IV shown in FIG. 3D.

As shown in FIG. 1B, in this embodiment, the wall-side opening 13 formed on the wall 11 has a rectangular opening surface and is enclosed by an upper side line part 13*b*, a lower side line part 13*c*, and two lateral side line parts 13*a*. As shown in FIG. 4A, the opening 2*b* of the container 2 has a shape corresponding to the wall-side opening 13 and is configured to have the same or a little smaller size than the wall-side opening 13.

As shown in FIG. 1B, in this embodiment, the gas purge units 20 are respectively attached at both of the lateral side line parts 13*a* of the wall-side opening 13 on an inner surface of the wall 11 to avoid touching the door 18. The inner surface of the wall 11 is a surface of the wall 11 opposite to the installation stand 12.

As shown in FIG. 3D and FIG. 4A, each of the gas purge units 20 is placed at both of the lateral side line parts 13*a* of the wall-side opening 13 so as to be longer along the Z-axis direction than the opening 2*b* of the container 2. Each of the gas purge units 20 has the bidirectional blowout member 22.

Figure 1C:
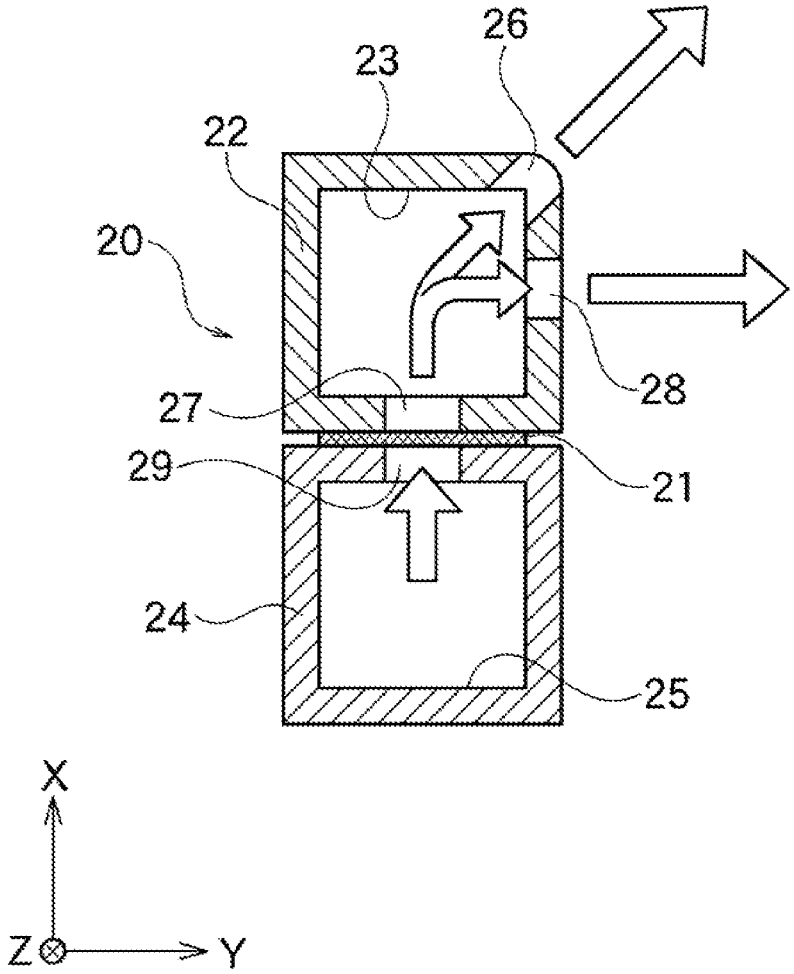
FIG. 1C is a cross-sectional view of the gas purge unit shown in FIG. 1B.

In this embodiment, the bidirectional blowout member 22 is made of a tube member that is narrow and long in the Z-axis direction and includes a blowout channel 23 which may hereinafter interchangeably be referred to as a common blowout channel, with square cross sectional shape and a first nozzle outlet 26 at a corner thereof, as shown in FIG. 1C. Also a second nozzle outlet 28 is formed on a plain portion of the square-tube bidirectional blowout member 22 so as to be adjacent to the first nozzle outlet 26.

Figures 2A, 2B, 2C, 2D:
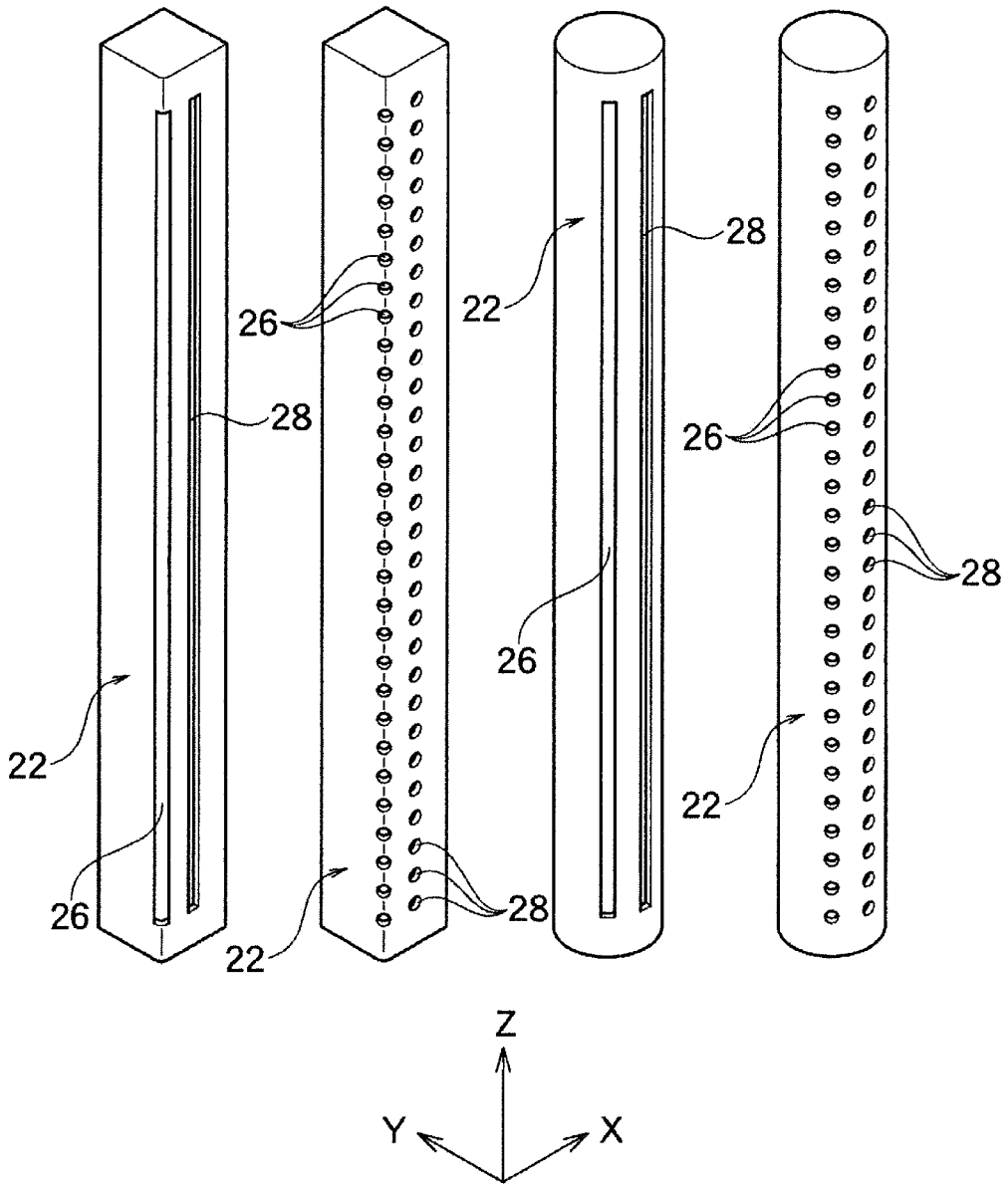
FIG. 2A is a perspective view of a bidirectional blowout member of the gas purge unit shown in FIG. 1C.
FIG. 2B is a perspective view showing a variation of the bidirectional blowout member shown in FIG. 2A.
FIG. 2C is a perspective view showing another variation of the bidirectional blowout member shown in FIG. 2A.
FIG. 2D is a perspective view showing a still another variation of the bidirectional blowout member shown in FIG. 2A.

In this embodiment, as shown in FIG. 2A, the first nozzle outlet 26 and the second nozzle outlet 28 are respectively made of a slit-like through hole continuously formed in the Z-axis direction of the square-tube bidirectional blowout member 22, and are parallel to each other with a predetermined distance in the X-axis direction.

As shown in FIG. 1C, an intake member 24 may be connected to the bidirectional blowout member 22, although not necessarily needed. In this embodiment, as is the case with the bidirectional blowout member 22, the intake member 24 is made of a tube member that is narrow and long in the Z-axis direction, and includes a blowout channel 25 with square cross sectional shape. A connecting hole 27 formed on the bidirectional blowout member 22 and a connecting hole 29 formed on the intake member 24 are connected through a filter 21.

For example, each of the connecting holes 27 and 29 is made of a slit-like through hole continuously formed in the Z-axis direction or intermittently made of a through hole. A cleaning gas circulating through the intake channel 25 of the intake member 24 goes into the blowout channel 23 of the bidirectional blowout member 22 through the connecting holes 27 and 29 and the filter 21, and is blown out from the first nozzle outlet 26 and the second nozzle outlet 28 to the outside.

The intake member 24 allows a more uniform flow speed of the cleaning gas in the Z-axis direction blown out from the first nozzle outlet 26 and the second nozzle outlet 28 to the outside. Alternatively, the intake member 24 also allows an intentionally controlled flow speed of the cleaning gas along the Z-axis direction blown out from the first nozzle outlet 26 and the second nozzle outlet 28.

A gas supply to the bidirectional blowout member 22 through the intake member 24 or a direct gas supply to the bidirectional blowout member 22 is not illustrated in the figures, but may be performed together with the gas purge units 20 from above or below of the Z-axis, for example. Also, a gas supply may be performed from below in one of the gas purge units 20, and a gas supply may be performed from above in the other gas purge unit 20.

Note that, the first nozzle outlet 26 and the second nozzle outlet 28 are made of a slit-like narrow and long blowout hole in this embodiment, but may be combinations of a plurality of blowout holes. Also, these nozzle outlets 26 and 28 may be slit-like through holes formed along the longitudinal direction of a tube member, circular through holes, or through holes formed inside of nozzles protruding from a tube member. Further, the first nozzle outlet 26 and the second nozzle outlet 28 are not necessarily made of the same kind of through holes. For example, the first nozzle outlet 26 may be made of a slit-like through hole and the second nozzle outlet 28 may be made of a combination of a plurality of blowout holes, or the contrary is possible. In this embodiment, as shown in FIG. 2C and FIG. 2D, the bidirectional blowout member 22 may have a cylindrical shape or any other cylindrical shape.

In the present embodiment, as shown in FIG. 4A, a pair of the bidirectional blowout members 22 are oppositely attached on the inner surface of the wall 11 at both of the lateral side line parts 13*a* of the wall-side opening 13. That is, gases blown out from the first nozzle outlets 26 are directed to the inside of the container 2, and gases blown out from the second nozzle outlets 28 are directed along the opening surface of the openings 13 and 2*b*.

In the present embodiment, the gases blown out from the second nozzle outlets 28 formed on the respective bidirectional blowout members 22 oppositely flow to cover the opening surface of the openings 13 and 2*b*, and a curtail flow is created. Also, the gases blown out from the first nozzle outlets 26 formed on the respective bidirectional blowout members 22 flow toward the inside of the container 2 to cross at the substantially central area of the wafers 1.

Figure 4B:
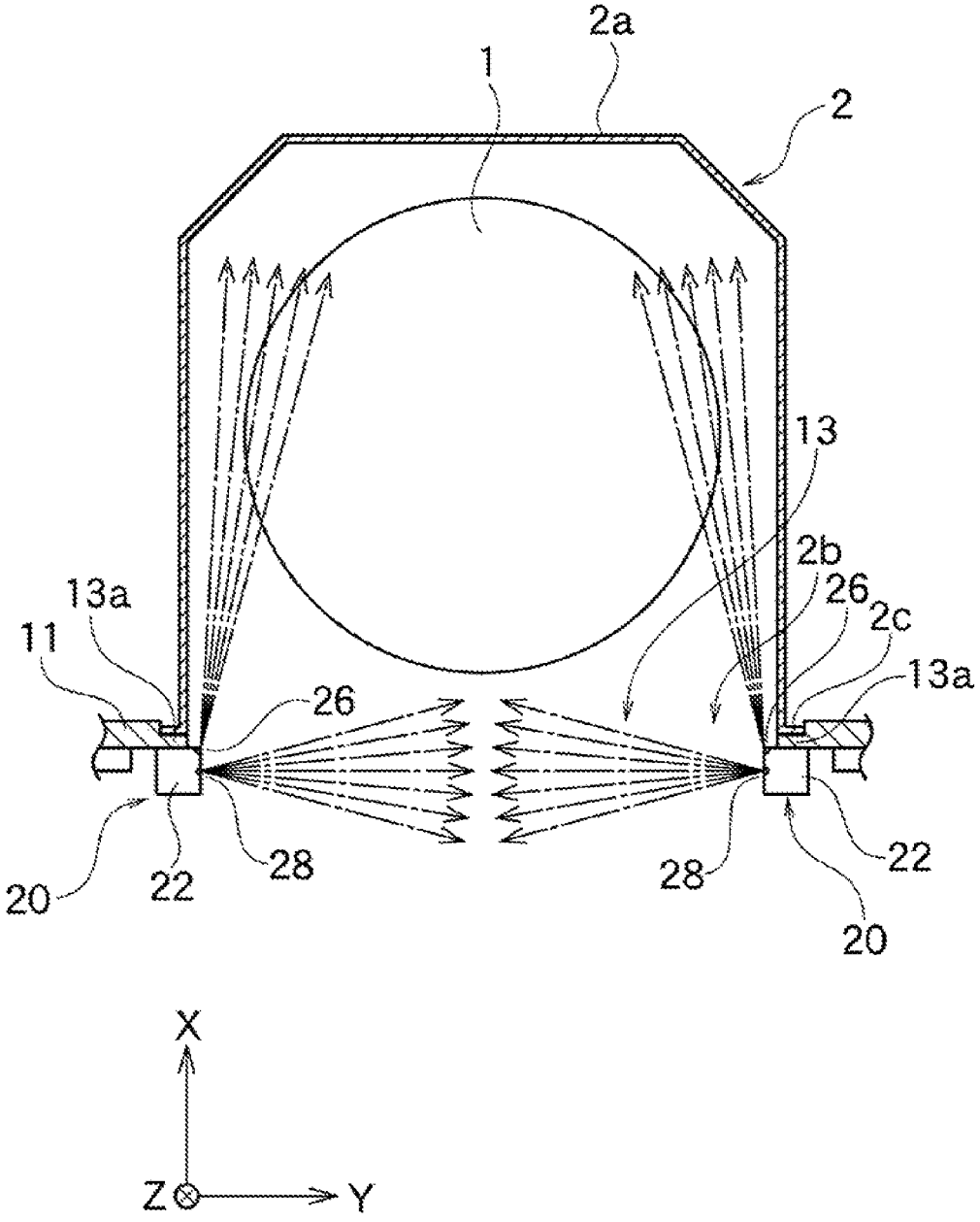
FIG. 4B is a cross-sectional view in a container similar to the container of FIG. 4A showing a gas purge unit according to another embodiment of the present invention.

Note that, in the present embodiment, the gases blown out from the first nozzle outlets 26 flow to any direction toward the inside of the container 2, and for example, flow to the periphery of the wafers 1 along the inner wall of the casing 2*a* as shown in FIG. 4B. Preferably, the gases blown out from a pair of the first nozzle outlets 26 and 26 flow symmetrically to the X-axis going through the center of the wafers 1, but may not necessarily flow symmetrically.

Further, in the present embodiment, each of the gases blown out from the second nozzle outlets 28 and 28 preferably has the same flow rate, but may have a different flow rate. Similarly, each of the gases blown out from the first nozzle outlets 26 and 26 preferably has the same flow rate, but may have a different flow rate.

Q1/Q2 may be configured to be variable when Q1 is defined as a flow rate of the gases blown out from the first nozzle outlets 26 and Q2 is defined as a flow rate of the gases blown out from the second nozzle outlets 28. To adjust the flow rate ratio, the first nozzle outlets 26 and the second nozzle outlets 28 may have a different opening area, a partition plate inside of the members 22, or the different number of the blowout holes.

In the present embodiment, the first nozzle outlets 26 and the second nozzle outlets 28 have the same length in the Z-axis direction and preferably have substantially the same length in the Z-axis direction as the height in the Z-axis direction of the opening 2*b* of the container 2, as shown in FIG. 3D. Such a structure allows the cleaning gas blown out from the first nozzle outlets 26 to circulate the front and rear surfaces of all the wafers 1 housed inside of the container 2.

Note that, in the present embodiment, the first nozzle outlets 26 and the second nozzle outlets 28 do not necessarily have the same length in the Z-axis direction, and the second nozzle outlets 28 may have the length in the Z-axis direction that is longer than the length in the Z-axis direction of the first nozzle outlets 26, for example. In this case, a dirty gas is effectively prevented from flowing from the inside of the wall 11 to the inside of the container 2. Also, the first nozzle outlets 26 do not necessarily have the same length in the Z-axis direction as the height in the Z-axis direction of the opening 2*b* of the container 2, and may have the length in the Z-axis direction that is shorter than the height in the Z-axis direction of the opening 2*b* of the container 2.

The gases blown out from the first nozzle outlets 26 and the second nozzle outlets 28 may be any type of gas, but may be inert gas, for example. This is because these gases at least need to have the cleanliness that is higher (no particles or water) than that of the internal environment of the wall 11. The gases blown out from the first nozzle outlets 26 and the second nozzle outlets 28 are preferably the same type and preferably have the same cleanliness, but these type and cleanliness may be changed.

In the gas purge units 20 of the present embodiment, each of the second nozzle outlets 28 blowing the cleaning gas G toward the opening surface S of the opening 13 is arranged inside of the wall 11 along both of the lateral side line parts 13*a* of the opening 13. Thus, the gas flow blown out from the respective second nozzle outlets 28 generates a curtain flow that blocks the flow from the outside of the container 2 (the inside of the wall 11) into the container 2 through the opening 13.

This curtain flow is generated from the lateral side line parts 13*a* of the opening 13 parallel to the Z-axis direction, and is thus uniform in the vertical direction (Z-axis direction) of the container 2. The first nozzles 26 blowing the cleaning gas toward the inside of the container 2 are also arranged along the lateral side line parts 13*a* of the opening 13, and thus the container-inward flow (the flow directing to the inside of the container 2) is uniform in the vertical direction of the container 2.

The present embodiment thus makes it possible to uniformly perform gas exchange within the container 2 particularly in the vertical direction. As a result, it is possible to obtain a uniform quality of objects to be treated such as the multiple wafers 1 housed in the Z-axis direction in the container 2.

In the present embodiment, the first nozzle outlet 26 and the second nozzle outlet 28 are formed on the single bidirectional blowout member 22. This can reduce the number of parts and contributes to downsizing of the unit 20.

The bidirectional blowout member 22 is arranged at least at one of both of the lateral side line parts 13*a* of the opening 13. In the present embodiment, however, the bidirectional blowout members 22 are oppositely arranged at both of the lateral side line parts 13*a* of the opening 13. In this construction, the curtain flow from both of the lateral side line parts 13*a* is generated, which increases the effect of blocking the flow from the outside to the inside of the container 2 through the opening 13. Also, the cleaning gases toward the inside of the container 2 blow out from two points of both of the lateral side line parts 13*a* of the opening 13, and thus gas exchange in the container 2 is performed quickly and uniformly.

In the present embodiment, the curtain flow can be formed using the second nozzle outlets 28 and 28, and it is thus possible to remove a down-flow curtain nozzle 30 attached to the upper side line part 13*b* of the wall-side opening 13 shown in FIG. 1B and FIG. 3D. However, this down-flow curtain nozzle 30 may be used simultaneously.

There was conventionally no second nozzle outlet 28 but only the down-flow curtain nozzle 30, and thus the gas was possibly hard to reach the bottom of the container 2 as approaching it. For example, when the opening 2*b* of the container 2 had the height of 30 cm in the Z-axis direction, the down flow possibly reached only about 15 cm from the above. This is considered to be possibly caused by the diffusion of the down flow from the curtain nozzle 30 due to the influence of the down flow from the FFU 40 mounted on the top of the intermediate chamber 60 shown in FIG. 1A.

In the present embodiment, as shown in FIG. 4A and FIG. 4B, the second nozzle outlets 28 forming the curtain flow are formed at both of the lateral side line parts 13*a* of the opening 13. Thus, even if the gas flows reach only about 15 cm from the respective second nozzle outlets 28, the gas flows from the respective second nozzle outlets 28 are combined and can cover the whole surface of the opening 13.

Note that, it is also conceivable that the bottom side 13*c* is provided with a conventional curtain nozzle 30. However, there is a risk that the curtain flow from below to above is mixed by colliding with the down flow (cleanliness is low) from the FFU 40 shown in FIG. 1C, and that the gas with low cleanliness is not sufficiently prevented from entering into the container 2.

Second Embodiment

Figure 4C:
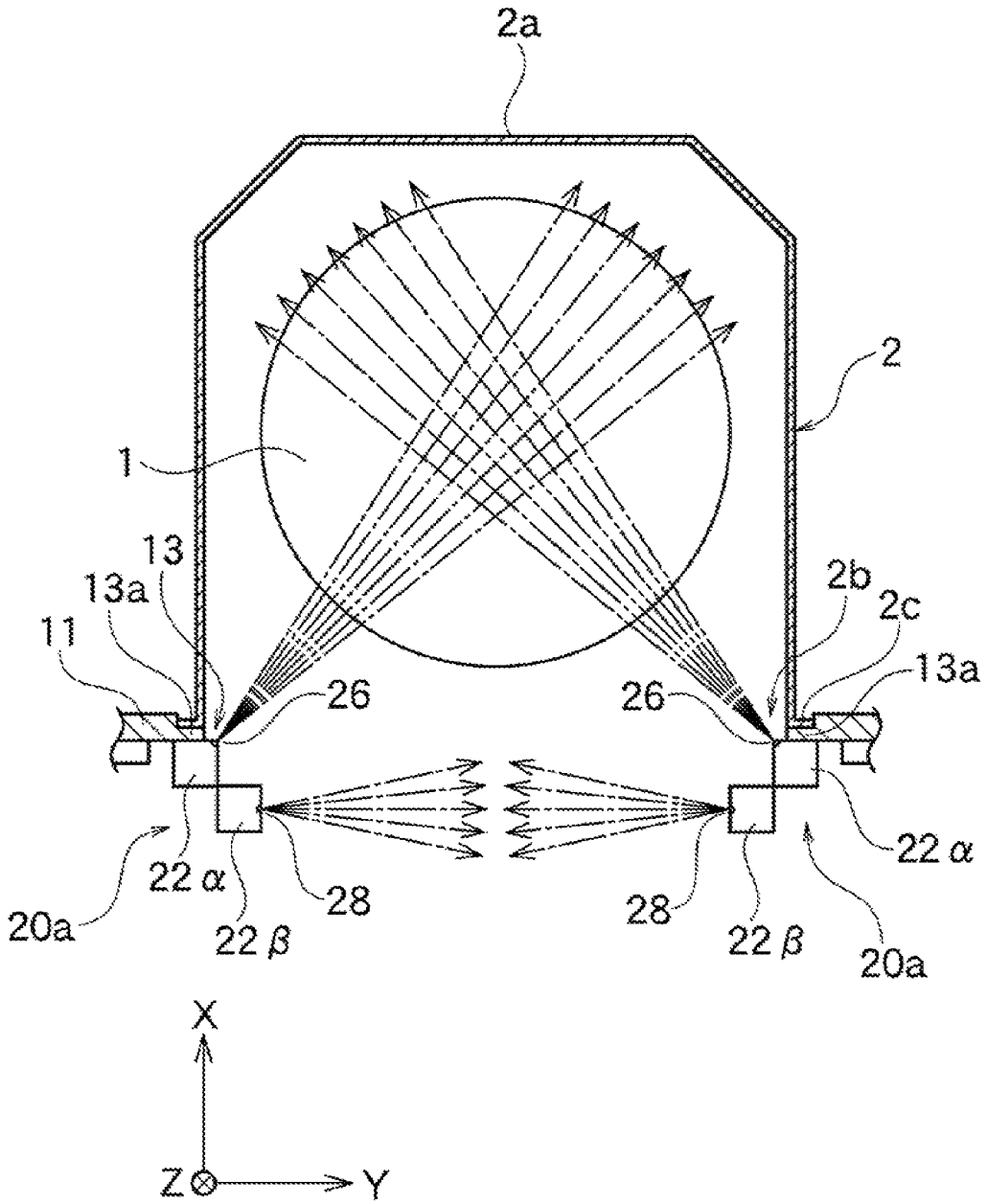
FIG. 4C is a cross-sectional view in a container similar to the container of FIG. 4A showing a gas purge unit according to another embodiment of the present invention.

FIG. 4C shows a combination of gas purge units 20*a* according to another embodiment of the present invention. In this embodiment, as shown in FIG. 4C, first nozzle outlets 26 are formed on first dedicated blowout members 22α, and second nozzle outlets 28 are formed on second dedicated blowout members 22β. At the first dedicated blowout members 22α, the second nozzle outlets 28 are not formed, but only the first nozzle outlets 26 are formed. Similarly, at the second dedicated blowout members 22β, the first nozzle outlets 26 are not formed, but only the second nozzle outlets 28 are formed.

In the present embodiment, the gas purge unit 20*a* composes of the first dedicated blowout member 22α and the second dedicated blowout member 22β, and the first dedicated blowout members 22α are arranged closer to an opening 13 than the second dedicated blowout members 22β. In this arrangement, the curtain flow blown out from the second nozzle outlets 28 of the second dedicated blowout members 22β is prevented from interfering with the container-inward flow blown out from the first nozzle outlets 26 of the first dedicated blowout members 22α, and both flows become smooth.

In the present embodiment, a common intake member 24, as shown in FIG. 1C, may be connected to each of the first dedicated blowout members 22α and the second dedicated blowout members 22β, or gases may be supplied using different intake means.

The present embodiment has the same structures and effects as the first embodiment, except that the gas purge units 20*a* compose of the first dedicated blowout members 22α and the second dedicated blowout members 22β, and that the number of parts increases compared to the first embodiment.

Third Embodiment

Figure 4D:
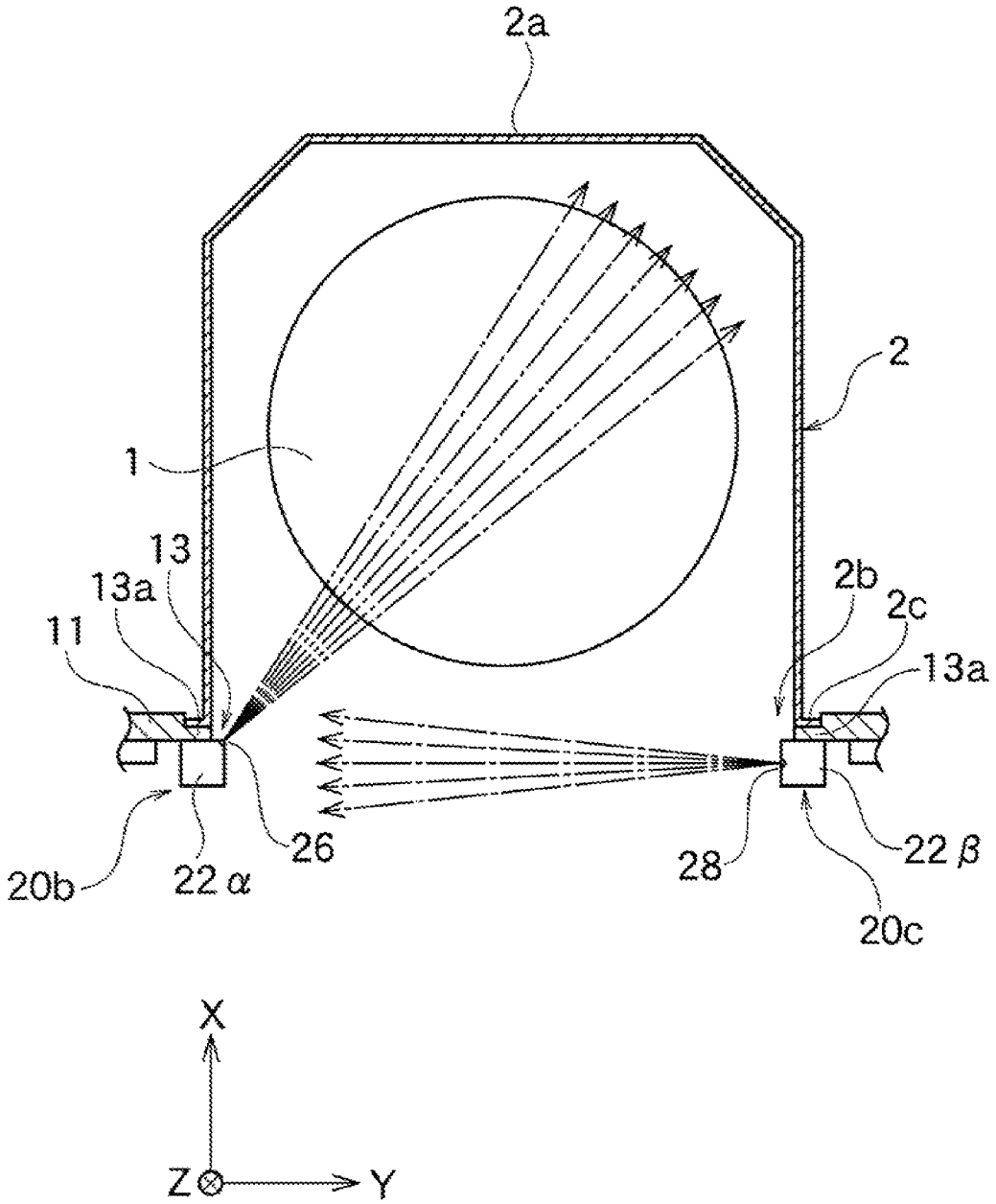
FIG. 4D is a cross-sectional view in a container similar to the container of FIG. 4A showing a gas purge unit according to another embodiment of the present invention.

FIG. 4D shows a combination of gas purge units 20*b* and 20*c* according to another embodiment of the present invention. In this embodiment, as shown in FIG. 4D, a first nozzle outlet 26 is formed on a first dedicated blowout member 22α, and a second nozzle outlet 28 is formed on a second dedicated blowout member 22β.

In this embodiment, the gas purge unit 20*b* having no second dedicated blowout member 22β but having the first dedicated blowout member 22α is fixed on the inner surface of a wall 11 along the Z-axis direction of one of lateral side line parts 13*a* of an opening 13. Similarly, the gas purge unit 20*c* having no first dedicated blowout member 22α but having the second dedicated blowout member 22β is fixed on the inner surface of the wall 11 along the Z-axis direction of the other lateral side line part 13*a* of the opening 13.

In this embodiment, a container-inward flow is formed by only the first dedicated blowout member 22α, and a curtain flow is formed by only the second dedicated blowout member 22β. The other structures and effects are the same as the first embodiment or the second embodiment. Note that, the gas blown out from the first nozzle outlet 26 of the first dedicated blowout member 22α is not directed only as shown in FIG. 4D, but may flow along the inner wall of a casing 2*a* of a container 2 as shown in FIG. 4E, for example.

Figure 4E:
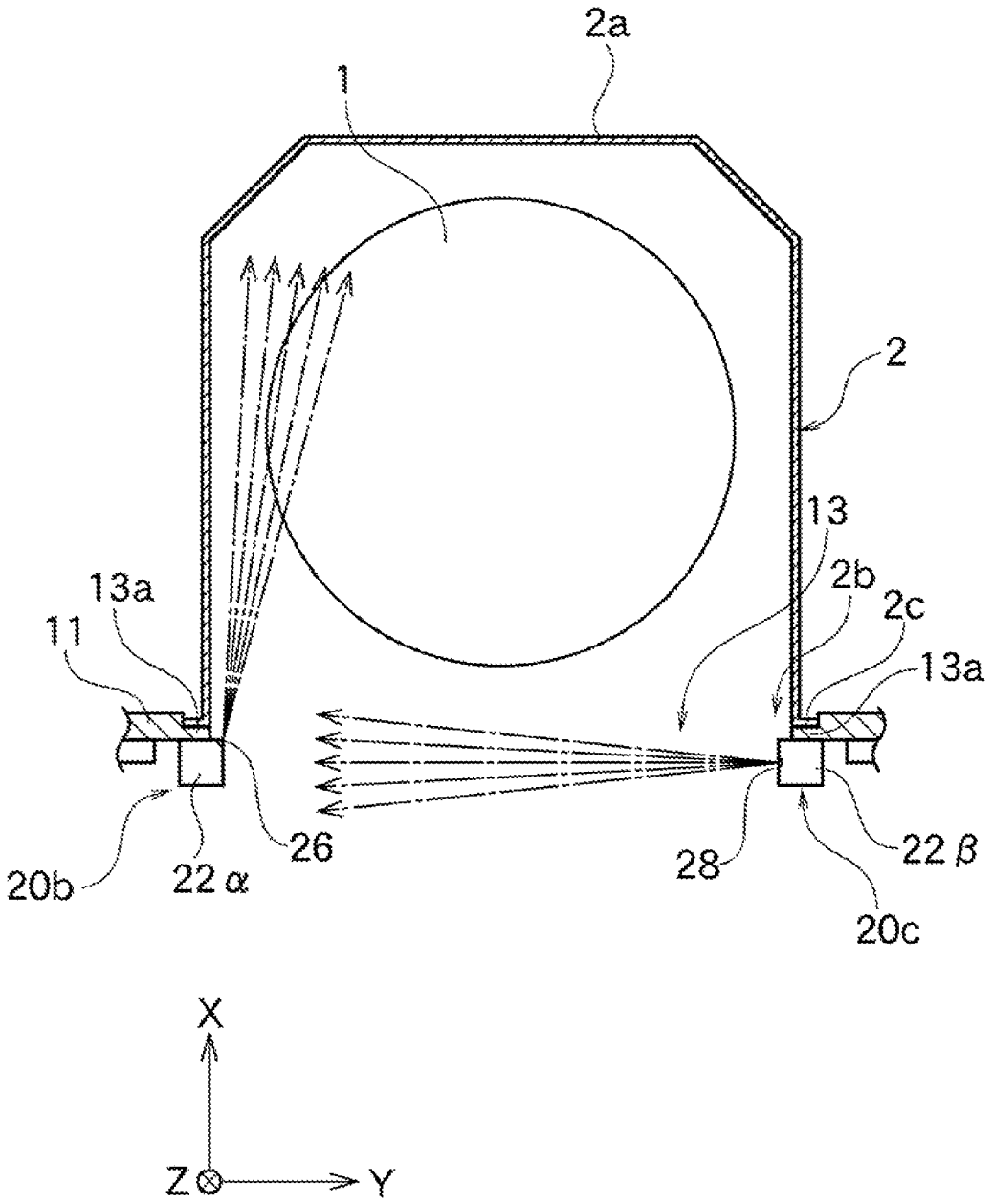
FIG. 4E is a cross-sectional view in a container similar to the container of FIG. 4A showing a gas purge unit according to another embodiment of the present invention.

As shown in FIG. 4E, a gas flow circulating clockwise along the wall surface of the casing 2*a* is formed in the container 2 by the gas flow blown out from the first nozzle outlet 26 and the gas flow blown out from the second nozzle outlet 28. As a result, gas exchange in the container 2 can be easily performed while obtaining a curtain effect at an opening surface of the opening 13.

Fourth Embodiment

Figure 4F:
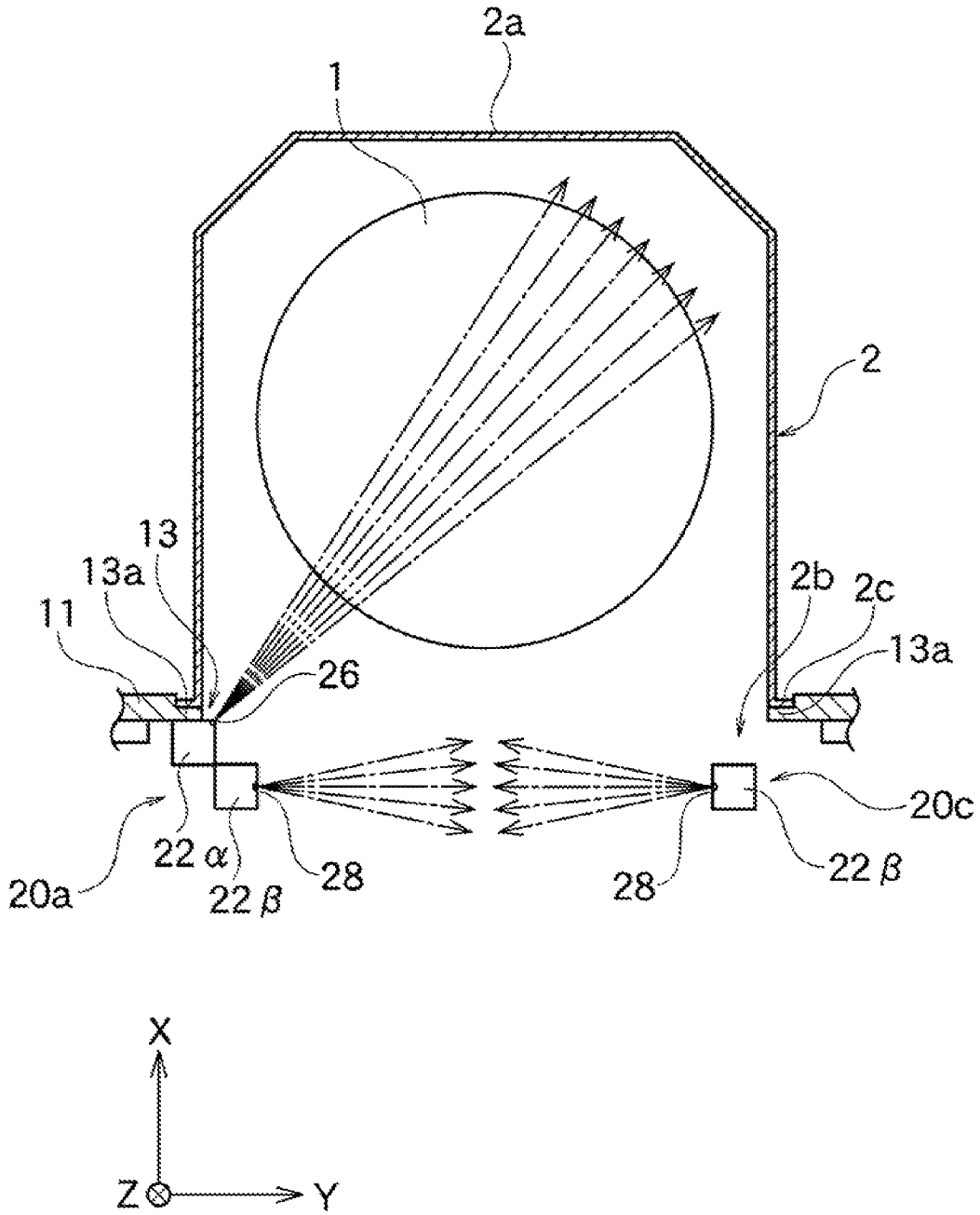
FIG. 4F is a cross-sectional view in a container similar to the container of FIG. 4A showing a gas purge unit according to another embodiment of the present invention.

FIG. 4F shows a combination of gas purge units 20*a* and 20*c* according to another embodiment of the present invention. In this embodiment, as shown in FIG. 4F, a first nozzle outlet 26 is formed on a first dedicated blowout member 22α, and second nozzle outlets 28 are formed on second dedicated blowout members 22β.

In this embodiment, the gas purge unit 20*a* having the second dedicated blowout member 22β and the first dedicated blowout member 22α is fixed on the inner surface of a wall 11 along the Z-axis direction of one of lateral side line parts 13*a* of an opening 13. Also, the gas purge unit 20*c* having no first dedicated blowout member 22α but having the second dedicated blowout members 22β is fixed on the inner surface of the wall 11 along the Z-axis direction of the other lateral side line part 13*a* of the opening 13.

In this embodiment, a container-inward flow is formed by only the first dedicated blowout member 22α, and a curtain flow is formed by a pair of the second dedicated blowout members 22β. The other structures and effects are the same as the first to third embodiments. Note that, as is the case with the above-mentioned embodiments, the gas blown out from the first nozzle outlet 26 of the first dedicated blowout member 22α is not directed only as shown in FIG. 4F.

Fifth Embodiment

Figure 4G:
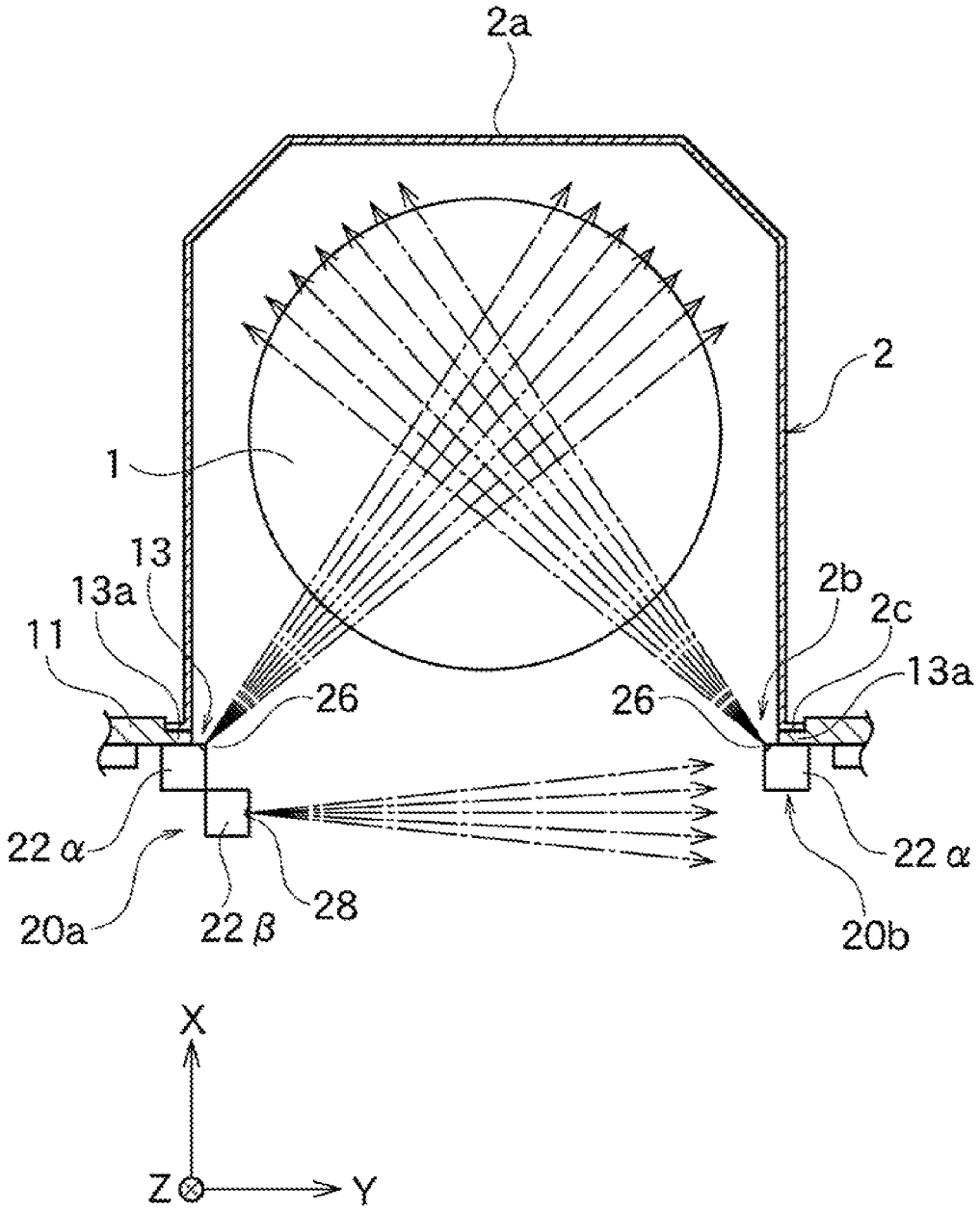
FIG. 4G is a cross-sectional view in a container similar to the container of FIG. 4A showing a gas purge unit according to another embodiment of the present invention.

FIG. 4G shows a combination of gas purge units 20*a* and 20*b* according to another embodiment of the present invention. In this embodiment, as shown in FIG. 4G first nozzle outlets 26 are formed on first dedicated blowout members 22α, and a second nozzle outlet 28 is formed on a second dedicated blowout member 22β.

In this embodiment, the gas purge unit 20*a* having the second dedicated blowout member 22β and the first dedicated blowout member 22α is fixed on the inner surface of a wall 11 along the Z-axis direction of one of lateral side line parts 13*a* of an opening 13. Also, the gas purge unit 20*b* having no second dedicated blowout member 22β but having the first dedicated blowout member 22α is fixed on the inner surface of the wall 11 along the Z-axis direction of the other lateral side line part 13*a* of the opening 13.

In this embodiment, a container-inward flow is formed by a pair of the first dedicated blowout members 22α, and a curtain flow is formed by only the second dedicated blowout member 22β. The other structures and effects are the same as the first to fourth embodiments. Note that, as is the case with the above-mentioned embodiments, the gases blown out from the first nozzle outlets 26 of the first dedicated blowout members 22α are not directed only as shown in FIG. 4G.

Sixth Embodiment

Figure 4H:
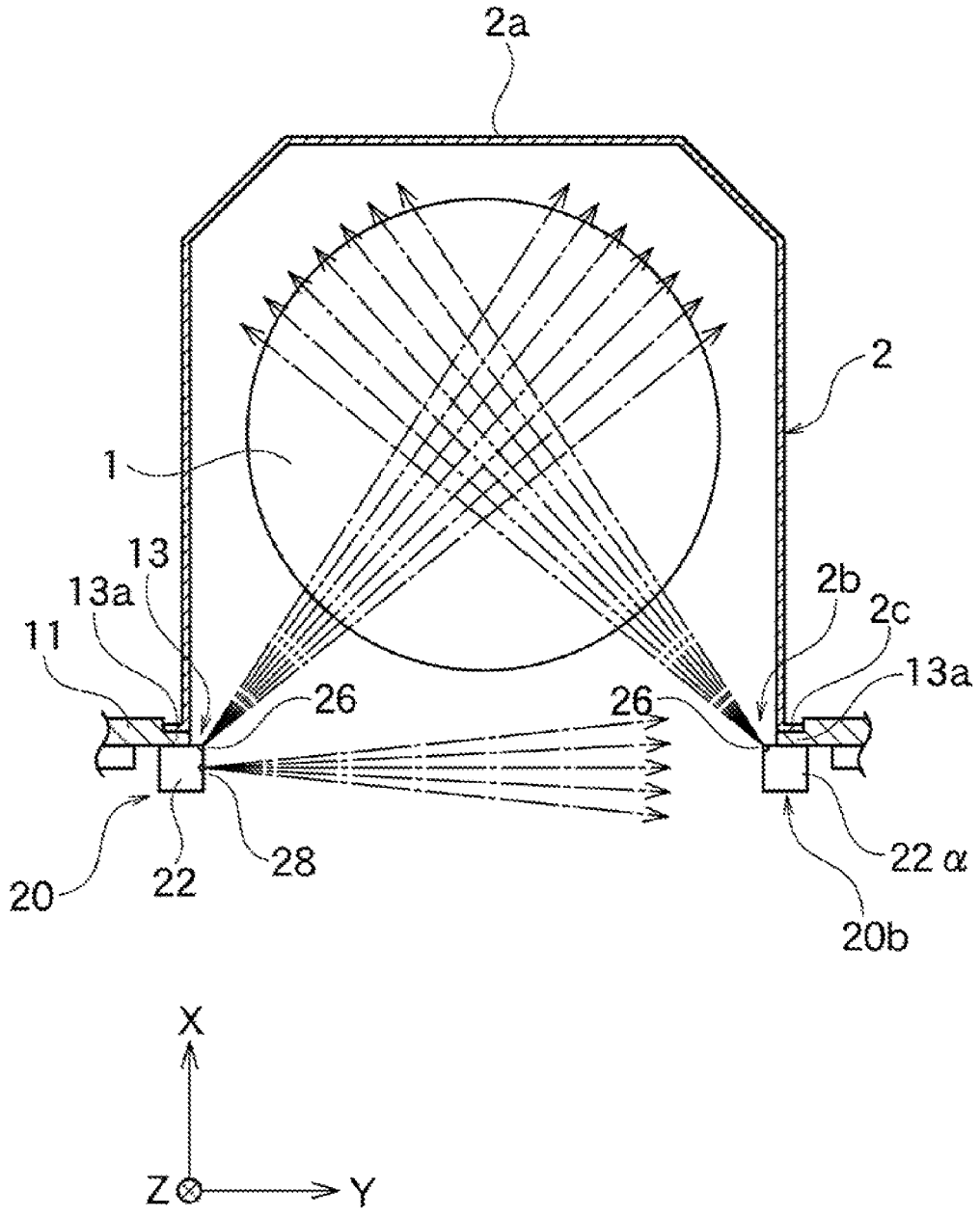
FIG. 4H is a cross-sectional view in a container similar to the container of FIG. 4A showing a gas purge unit according to another embodiment of the present invention.

FIG. 4H shows a combination of gas purge units 20 and 20*b* according to another embodiment of the present invention. In this embodiment, as shown in FIG. 4H, the gas purge unit 20 having a bidirectional blowout member 22 is fixed on the inner surface of a wall 11 along the Z-axis direction of one of lateral side line parts 13*a* of an opening 13. Also, the gas purge unit 20*b* having no second dedicated blowout member 22β but having a first dedicated blowout member 22α is fixed on the inner surface of the wall 11 along the Z-axis direction of the other lateral side line part 13*a* of the opening 13.

In this embodiment, a container-inward flow is formed by a pair of the first nozzle outlets 26. The other structures and effects are the same as the first to fifth embodiments. Note that, as is the case with the above-mentioned embodiments, the gas blown out from the first nozzle outlet 26 of the bidirectional blowout member 22 is not directed only as shown in FIG. 4H.

Seventh Embodiment

Figure 4I:
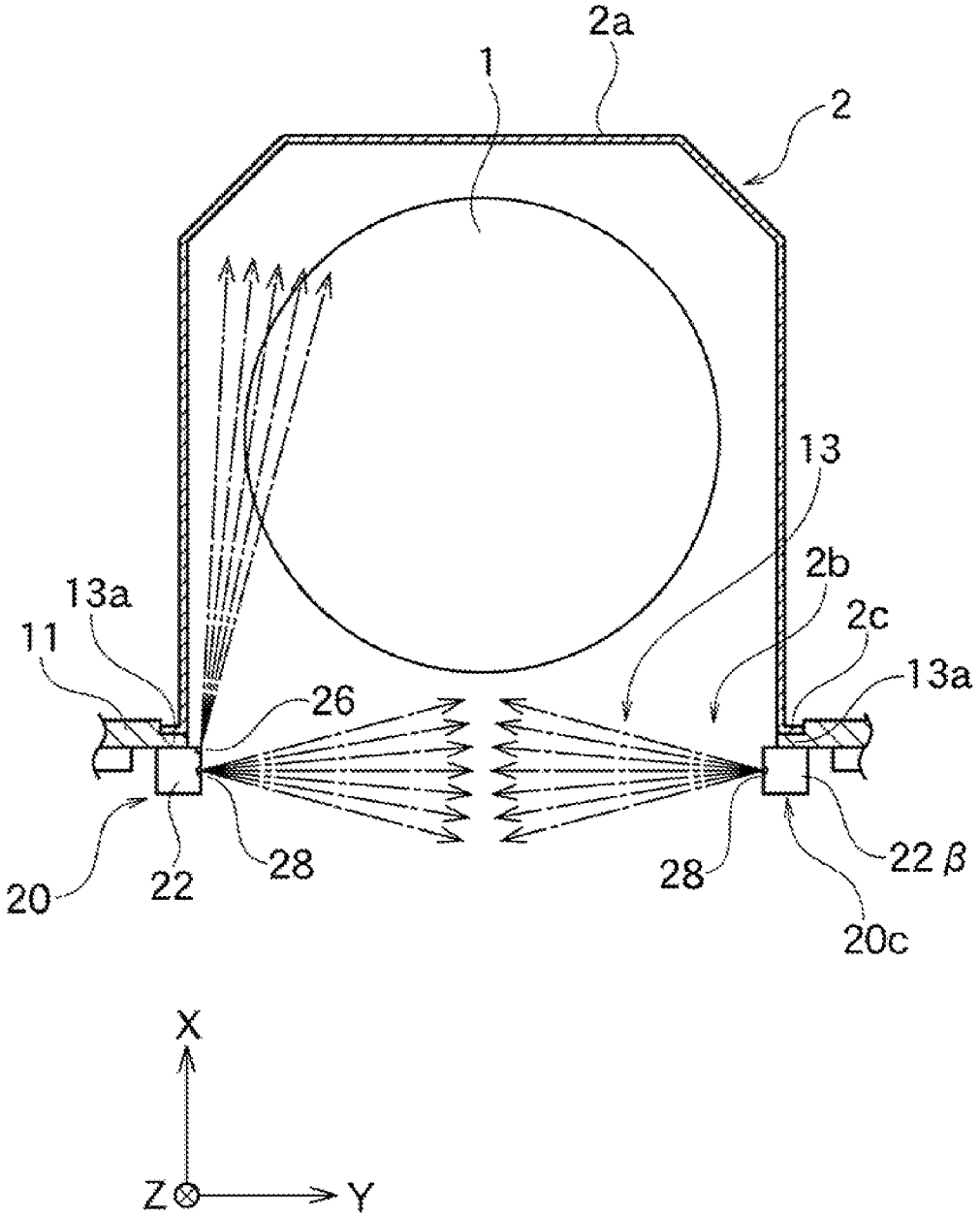
FIG. 4I is a cross-sectional view in a container similar to the container of FIG. 4A showing a gas purge unit according to another embodiment of the present invention.

FIG. 4I shows a combination of gas purge units 20 and 20*c* according to another embodiment of the present invention. In this embodiment, as shown in FIG. 4I, the gas purge unit 20 having a bidirectional blowout member 22 is fixed on the inner surface of a wall 11 along the Z-axis direction of one of lateral side line parts 13*a* of an opening 13. Also, the gas purge unit 20*c* having no first dedicated blowout member 22α but having a second dedicated blowout member 22β is fixed on the inner surface of the wall 11 along the Z-axis direction of the other lateral side line part 13*a* of the opening 13.

In this embodiment, a container-inward flow is formed by only the first nozzle outlet 26. The other structures and effects are the same as the first to sixth embodiments. Note that, as is the case with the above-mentioned embodiments, the gas blown out from the first nozzle outlet 26 of the bidirectional blowout member 22 is not directed only as shown in FIG. 4I.

Note that, the present invention is not limited to the above-mentioned embodiments, but can be variously changed within the scope thereof.

For example, the gas purge unit of the present invention is applied to the load port apparatus 10 as a gas purge apparatus in the above-mentioned embodiments, but may be applied to the other apparatuses. For example, the gas purge unit of the present invention may be applied to other apparatuses or places where a clean environment is required.

NUMERICAL REFERENCES

1 . . . wafer
2 . . . sealed transport container
2*a* . . . casing
2*b* . . . opening
2*c* . . . opening edge
3 . . . positioning portion
4 . . . lid
5 . . . intake port
6 . . . exhaust port
10 . . . load port apparatus
11 . . . wall
12 . . . installation stand
13 . . . wall-side opening
13*a* . . . lateral side line part
13*b* . . . upper side line part
13*c* . . . lower side line part
14 . . . movable table
16 . . . positioning pin
18 . . . door
20 and 22*a* to 22*c* . . . gas purge unit
21 . . . filter
22 and 22*a* to 22*c* . . . bidirectional blowout member
22α . . . first dedicated blowout member
22β . . . second dedicated blowout member
23 . . . blowout channel
24 . . . intake member
25 . . . intake channel
26 . . . first nozzle outlet
27 . . . connecting hole
28 . . . second nozzle outlet
29 . . . connecting hole
30 . . . curtain nozzle
40 . . . FFU
50 . . . robot arm
60 . . . intermediate chamber
70 . . . processing chamber

The invention claimed is:

1. A gas purge unit for introducing a cleaning gas into a purge container with an opening therethrough, the gas purge unit comprising:

first and second opposed lateral side line parts, an upper side line part, and a lower side line part at least partially defining the opening of the gas purge container;

a first nozzle outlet blowing out the cleaning gas towards an inside of the purge container from the first lateral side line part; and a second nozzle outlet blowing out the cleaning gas from one of the lateral side line parts of the opening toward the other of the lateral side line parts along the opening, wherein the first nozzle outlet and the second nozzle outlet are formed independently from one another and are continuously or intermittently formed along a vertical direction, wherein the first nozzle directs the blown cleaning gas towards the insider of the purge container at an angle relative to the opening and the second nozzle directs the blown cleaning gas along the opening.

2. The gas purge unit as set forth in claim 1, wherein the first nozzle outlet and the second nozzle outlet are formed on a single bidirectional blowout member and the first nozzle outlet and the second nozzle outlet are adjacent to each other around a common blowout channel of the single bidirectional blowout member.

3. The gas purge unit as set forth in claim 2, wherein the single bidirectional blowout member and a second bidirectional blowout member are oppositely arranged at both of the two lateral side line parts of the opening.

4. The gas purge unit as set forth in claim 1, wherein the first nozzle outlet is formed on a first dedicated blowout member and the first dedicated blowout member is arranged at least at one of the two lateral side line parts of the opening.

5. The gas purge unit as set forth in claim 1, wherein the second nozzle outlet is formed on a second dedicated blowout member and the second dedicated blowout member is arranged at least at one of the two lateral side line parts of the opening.

6. The gas purge unit as set forth in claim 1, wherein the first nozzle outlet is formed on a first dedicated blowout member, the second nozzle outlet is formed on a second dedicated blowout member, a pair of the first dedicated blowout members are oppositely arranged at both of the two lateral side line parts of the opening, and the second dedicated blowout member is arranged at least at one of the two lateral side line parts of the opening.

7. The gas purge unit as set forth in claim 1, wherein the first nozzle outlet is formed on a first dedicated blowout member, the second nozzle outlet is formed on a second dedicated blowout member, a pair of the second dedicated blowout members are oppositely arranged at both of the two lateral side line parts of the opening, and the first dedicated blowout member is arranged at least at one of the two lateral side line parts of the opening.

8. The gas purge unit as set forth in claim 6, wherein the first dedicated blowout member is arranged closer to the opening than the second dedicated blowout member.

9. The gas purge unit as set forth in claim 7, wherein the first dedicated blowout member is arranged closer to the opening than the second dedicated blowout member.

10. The gas purge unit as set forth in claim 1, wherein the first nozzle outlet and the second nozzle outlet are continuously or intermittently formed along the longitudinal direction of the two lateral side line parts of the opening.

11. A gas purge apparatus comprising the gas purge unit as set forth in claim 1 attached to at least one of the two lateral side line parts of a wall-side opening of a wall, wherein the purge container is detachably attached from outside to the wall-side opening formed on the wall sealed internally and the opening of the purge container and the wall-side opening are airtightly connected.

12. The gas purge unit as set forth in claim 1, further comprising another second nozzle outlet, wherein the two second nozzle outlets are oppositely arranged at both of the two lateral side line parts of the opening.

* * * * *